US005213359A

United States Patent [19]

Girard

[11] Patent Number: 5,213,359

[45] Date of Patent: May 25, 1993

[54] BINDING FOR CROSS-COUNTRY SKIS

[75] Inventor: Francois Girard, Veyrier du Lac, France

[73] Assignee: Salomon S.A., Annecy Cedex, France

[21] Appl. No.: 743,940

[22] Filed: Aug. 12, 1991

[30] Foreign Application Priority Data

Aug. 21, 1990 [FR] France ..... 90 10612

[51] Int. Cl.[5] ..... A63C 9/20

[52] U.S. Cl. ..... 280/615

[58] Field of Search ..... 280/614, 615, 623, 627, 280/631, 632, 634

[56] References Cited

U.S. PATENT DOCUMENTS

| | | | |
|---|---|---|---|
| 2,614,858 | 10/1952 | Pierce, Jr. | 280/627 X |
| 4,309,833 | 1/1982 | Salomon | 280/632 X |
| 4,382,611 | 5/1983 | Salomon | 280/615 |
| 4,496,169 | 1/1985 | Salomon et al. | 280/615 |
| 4,647,064 | 3/1987 | Salomon et al. | 280/615 |
| 5,052,710 | 10/1991 | Provence et al. | 280/615 |
| 5,092,620 | 3/1992 | Girault et al. | 280/615 |

FOREIGN PATENT DOCUMENTS

| | | | |
|---|---|---|---|
| 3924915 | 2/1990 | Fed. Rep. of Germany . | |
| 2635014 | 2/1990 | France . | |
| 2638974 | 5/1990 | France . | |
| 2642980 | 8/1990 | France | 280/615 |
| 97886 | 1/1940 | Sweden | 280/615 |

*Primary Examiner*—Brian Johnson

*Attorney, Agent, or Firm*—Sandler Greenblum & Bernstein

[57] ABSTRACT

A binding including a fixed jaw and a movable jaw adapted to retain, on the ski, the tip of a boot provided with a transverse journal axle. The mechanism for closing the binding includes a knuckle joint formed, on the one hand, by a lever journalled on a slide bearing the movable jaw, and on the other hand, an elastic frame which is itself journalled on the lever that is supported on the mounting plate fixed on the ski. The support zone of the frame on the plate is elastically mobile frontwardly along a limited path. This displacement occurs by deformation of an elastic tongue carried by the base plate, which enables the binding to be closed even in the presence of a thin wedge of snow lodged between the jaws.

9 Claims, 3 Drawing Sheets

BINDING FOR CROSS-COUNTRY SKIS

BACKGROUND OF THE INVENTION

1. Field of the Invention

The present invention relates to a binding for cross-country skis.

More precisely, it is related to a binding adapted to retain a boot whose tip is provided with a transverse journal axle, on the ski.

2. Discussion of Background and Relevant Information

The type of binding to which the present invention is directed includes a mounting plate fixed on the ski, as well as a pair of jaws adapted to stretch and retain between them, the transverse axle provided on the tip of the boot; one of these jaws, called a fixed jaw, is affixed to the mounting plate, whereas the other jaw, called movable jaw, may be displaced axially on the ski, this binding including a knuckle joint latching system.

This system comprises, on the one hand, a lever for opening and closing the binding, which is journalled around a transverse axis affixed to the movable jaw, and on the other hand, a toggle link journalled on the lever, and taking support on the mounting plate.

A binding of this type is described in the document FR-A-2,638,974.

In a preferred embodiment of the binding, the toggle link is an elastic mount, which happens to be a wire spring stirrup that takes the general shape of a "U" in an elevational view.

The binding that has just been described is generally satisfactory to skiers practicing cross-country skiing, insofar as performance and ease of use is concerned.

The pivoting of the tip of the boot, when walking on skis, occurs against the resistance of an elastic pad mounted in the binding, and supported against the frontal portion, or nose, of the tip of the boot.

During closing on of the binding, which is done by deformation of the knuckle joint, this joint crosses an over-center line while the elastic mount deforms temporarily; after crossing the over-center line, the jaws are closed, and practically all risks of involuntary opening of the binding are eliminated.

Deliberate opening of the bindings is done by lifting the opening lever, which brings about deformation of the knuckle joint in the opposite direction, and distancing of the movable jaw with respect to the fixed jaw, thus resulting in the release of the journal axis of the boot.

In some conditions in which these bindings are used, difficulties related to the presence of a certain thickness of snow between the two jaws have been encountered.

This wedge of snow, whose thickness adds to the diameter of the journal axis of the boot, stops the movable jaw from being displaced normally, so much so that it is no longer possible to correctly activate the knuckle joint mechanism for closing the binding. In order to try and do this the skier risks exercising excessive pressure on the opening lever, and this may result in the deterioration of the binding.

SUMMARY OF THE INVENTION

An object of the present invention is to perfect the binding that has just been described, in order to enable closing of the binding, even if a certain thickness of snow is present in the jaw.

Another object of the invention is to ensure that, despite the presence of this snow, the quality of the retention of the boot of the ski is not altered, and that the skier is safe from sudden opening of the bindings.

These results are achieved according to the invention, by virtue of the fact that the support zone of the toggle link on the mounting plate is elastically mobile, in an axial direction and along a limited course, in the opposite direction from the latching direction of the movable jaw.

Thus, when the binding is closed, even if the displacement of the movable jaw is braked, or stopped, by the presence of a wedge of snow, the knuckle joint mechanism, whose toggle link support point may be displaced, manages to cross the over-center line, without this toggle link being subject to an excessive buttressing capable of blocking the movement.

In a preferred embodiment of the invention, the toggle link has a transverse arm that is in support against the elastically deformable inclined tongue which is provided on the mounting plate.

The elastic displacement of the support zone will thus occur by an angling effect, the transverse arm of the toggle link being used to raise this inclined tongue that acts as a ramp, during its movement.

Preferably, a vertically folded back part forms an abutment and is provided either directly on this tongue, or on one or more neighboring tongues, limiting the displacement of the transverse arm.

Advantageously, the toggle link is elastically deformable, and is constituted by a wire spring stirrup which, in an elevational view, takes the general shape of a "U", its base constituting the transverse arm, and its free ends, folded back at a right angle, forming bearing necks on the lever.

The mobile jaw is preferably borne by a slide which is guided in translation on the mounting plate.

According to another advantageous characteristic of the invention, the opening lever on the one hand, and the base plate on the other hand, have complementary engagement means adapted to stop the closing of the lever in case of abnormal positioning of the movable jaw with respect to the fixed jaw, especially following the presence of an excessively thick wedge of snow between the two jaws.

These complementary engagement means are, for example, notches arranged in the lever that cooperate with hooks provided on the mounting plate, these hooks being capable of penetrating into the notches only when they are positioned face to face with the latter.

Thus, if the wedge of snow is too thick, a condition that could lead to incorrect latching and could be the cause of involuntary removal of the binding, an arrangement like this enables such situations to be prevented because the skier is unable to close the bindings.

BRIEF DESCRIPTION OF THE DRAWINGS

The above and additional objects, characteristics, and advantages of the present invention will become apparent in the following detailed description of preferred embodiments, with reference to the accompanying drawings which are presented as non-limiting examples, in which.

DETAILED DESCRIPTION OF PREFERRED EMBODIMENTS

Figure 1:
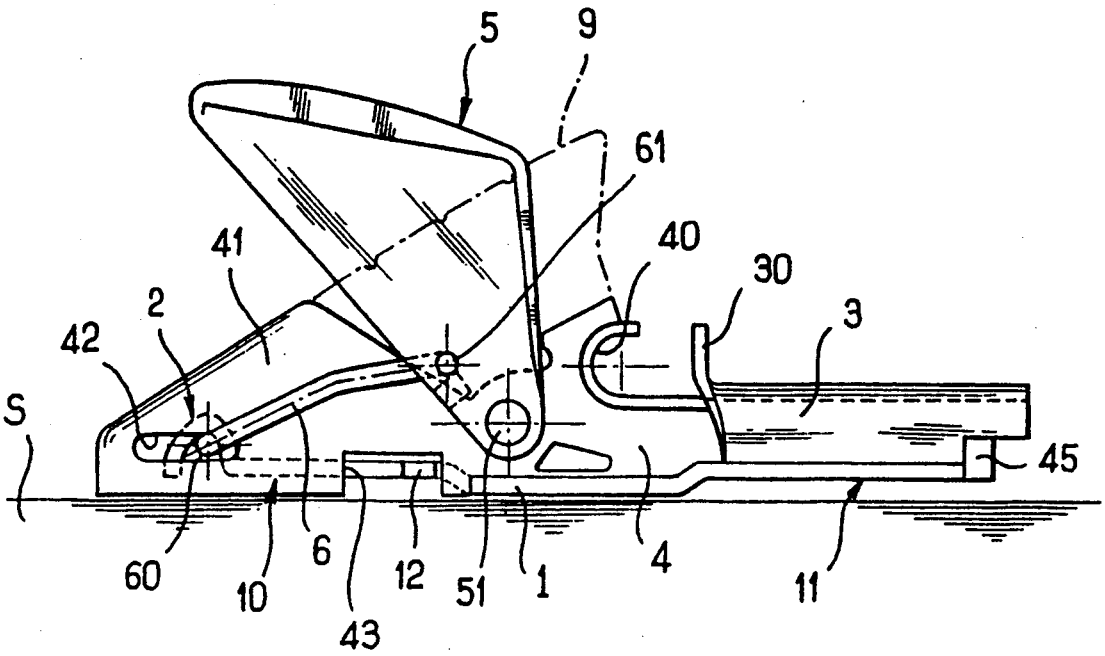
FIG. 1 is a side view of the binding, before being closed.
Figure 2:
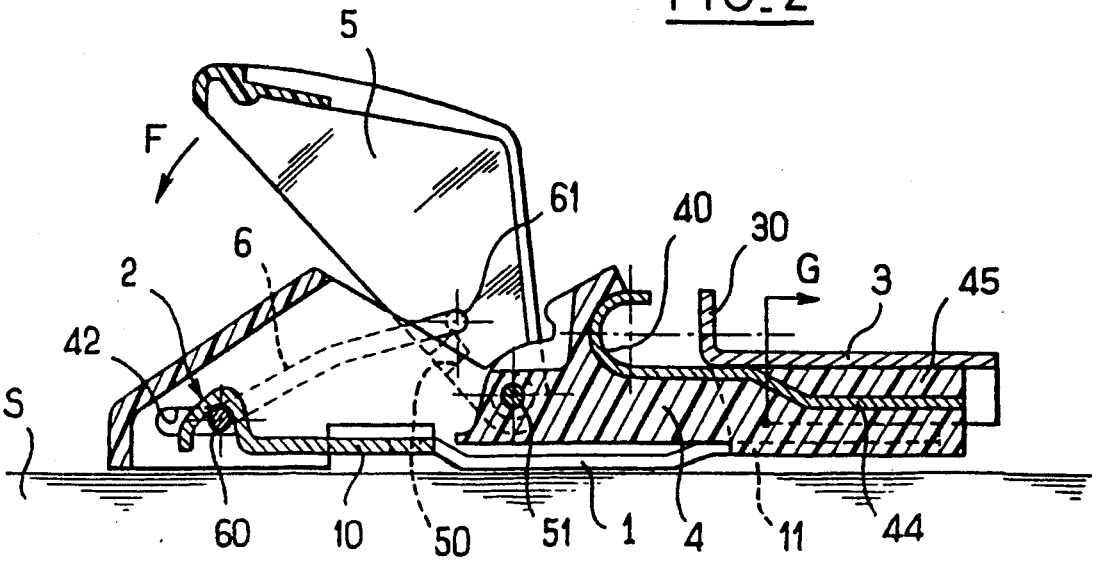
FIG. 2 is a similar view to FIG. 1, in an axial section.

The cross-country ski binding that is represented in FIGS. 1 and 2 is of the same general type as that commercialized by SALOMON S.A. under the commercial reference SNS Profil. The guiding rib of the sole that is normally mounted adjacent the binding has not been represented in the drawings.

This binding comprises a mounting plate 1, or a base plate, which is metallic and fixed on he cross-country ski by means of screws (not represented).

The tip of the ski can be found on the left side of the drawings.

The front and rear portions of plate 1, respectively references 10 and 11, are slightly distanced from the ski.

The central zone (in the vicinity of the axis of the ski) of the rear portion 11 is narrowed towards the top so as to form a tubular element 3 that acts as a guide for a plastic slide 4.

This portion 3 has a front edge portion 30 folded back at a right angle, i.e., arranged vertically, that constitutes the fixed jaw.

The slide 4 is affixed to a metallic plate 44, which, in view of portion 30, and to the front of this, is shaped like a semi-cylindrical channel, constituting the movable jaw 40. The elements 30 and 40 are adapted, as is well known, to wedge the transverse journal axle between them, this axle being provided at the tip of the cross-country ski boot. This axle is represented and referenced as 100 in FIG. 3.

Figure 3:
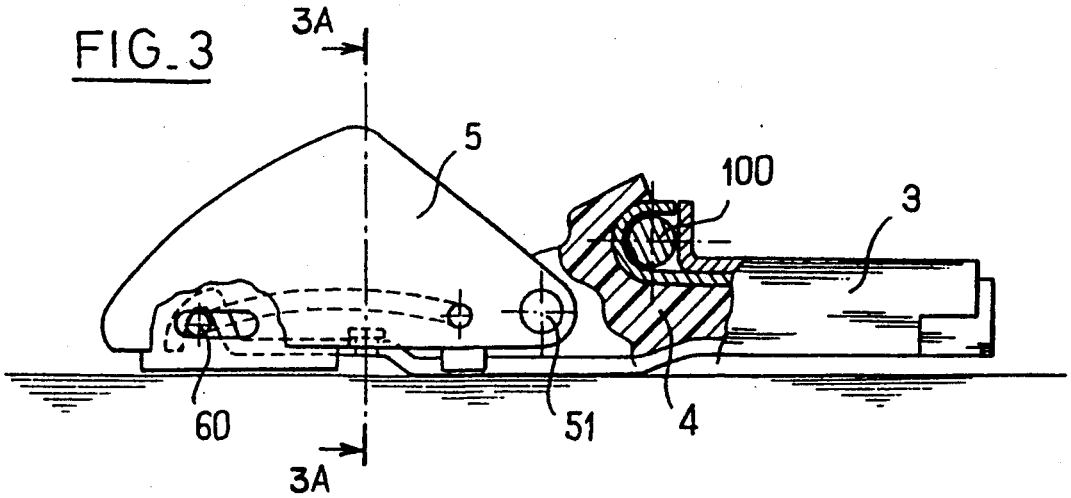
FIG. 3 is view similar to FIGS. 1 and 2, and represents, a partial section, after the binding closed.

The slide 4 extends towards the front of the ski by a portion 41 in the shape of a profiled casing. Slightly in front of portion 40, and at a level lower than that of this portion, the slide 4 is equipped with two transverse journal axes 51, on which a lever 5 for closing and opening is pivotally mounted. This lever has genera s of a cap surrounding slide 4, and is able to brush portion 41 when it is folded back on the ski (affixing position as illustrated in FIG. 3).

The binding is equipped with an elastic pad, which is represented in dotted and dashed lines in FIG. 1, and has a numerical reference 9. As is well known, pad 9 is retained within casing 41 by clipping; it is adapted to act as an elastic abutment for the nose of the boot during cross-country skiing.

Portion 10 of the mounting plate 1 bears, in the vicinity of central mounting plate portion 1, a pair of lateral hooks 12, whose role will be explained later. At this position, the lateral walls of the casing 41 have cut-outs 43 enabling passage of hooks 12, such that they do not hinder the displacement of slide 4 with respect to plate 1.

Figure 6:
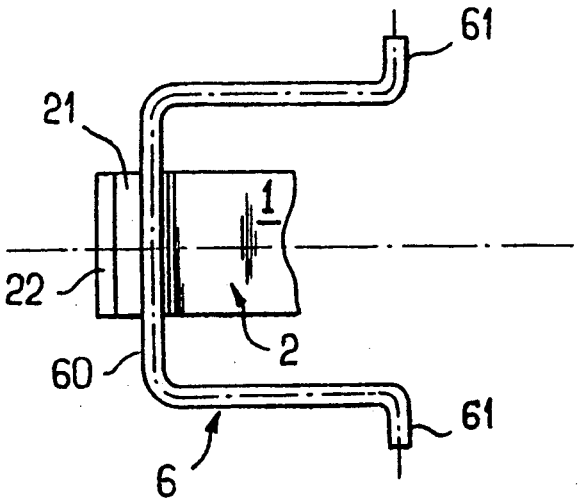
FIG. 6 represents an elevational view of the toggle link and that portion of mounting plate that acts as a support zone.

The binding is equipped with a toggle link 6 which is constituted by a wire spring metallic frame. As can be seen in FIG. 6, the element 6 has the general shape of a "U" with a transverse arm 60; the two lateral arms of element 6 have ends that are folded back at a right angle towards the outside, and are referenced by the number 61. The latter act as bearing necks for element 6 in the lateral cheeks of lever 5; the lateral arms of element 6 extend outside this portion in the shape of casing 41, along the lateral walls of the same; its transverse arm 60 crosses these walls through elongated holes 42, in the shape of slots, that extend horizontally along the axis of the ski.

As is well known, arm 60 is supported on the front portion 10 of plate 1.

However, according to a basic characteristic of the invention, the support zone of arm 60 with a part of plate 10 is elastically mobile along the axis of the ski, and towards the front thereof.

Figure 4:
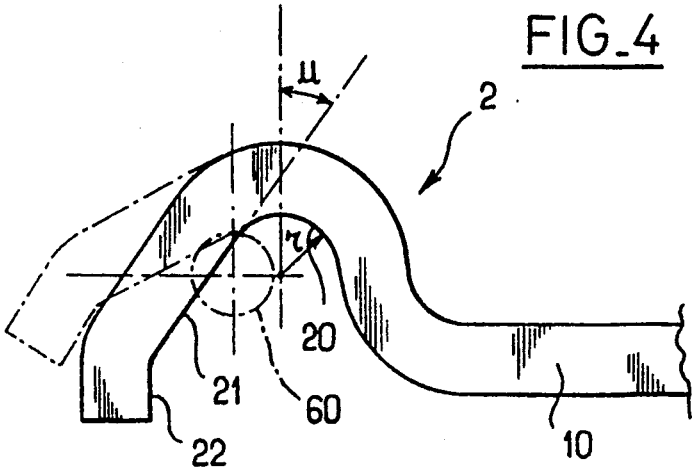
FIG. 4 represents, on a larger scale, the movable support zone of the toggle link with the mounting plate.

To this end, portion 10 has a front end 2 which is shaped in a special manner, as can be seen in more detail in FIG. 4. The portion comprises a zone that extends upwardly at a right angle towards the top with respect to portion 10, and then forms a zone approximately like a quarter of circle 20 and comes down towards the front and towards the base by forming an inclined tongue 21; the latter ends at an end zone 22 that is substantially vertical.

As an example, the diameter of arm 60 is about 2 mm, the radius r of zone 20 is about 1.3 mm; the angle u that forms the inclined zone 21 with the perpendicular is about 35°.

As can be seen in FIGS. 1-3, the lateral arms of the elastic element 6 are not rectilinear in a side view, but have two rectilinear portions that, between them, form a very open obtuse angle. It is this angularity that gives frame 6 the possibility of elastic deformation while affixing the binding, when the knuckle joint mechanism constituting lever 5 and element 6 crosses the over-center line.

Under normal usage conditions, that is, in the absence of a wedge of snow between the two jaws 30 and 40, the arm 60 is retained in the semi-cylindrical zone 20 of portion 2 of base plate 1. To close the binding, once the tip of the boot has been correctly positioned against the binding, such that axle 100 is positioned between jaws 30 and 40, all that needs to be done is to pivot lever 5 towards the base in order to close latch the binding (arrow F FIG. 2).

As and when the lever 5 pivots, by virtue of the knuckle joint effect, due to the fact that arm 60 is fixed, axis 51 is displaced towards the rear; slide 4, guided in translation in the fixed portion 3, is thus displaced towards the rear, a is progressively applied against portion 30, imprisoning axle 100; the displacement towards the rear of slide 4 and or the movable jaw 40 which is affixed to it, is illustrated by arrow G in FIG. 2. The deformation of the knuckle joint 5, 6 occurs when axis 61 crosses an over-center line when lever 5 is completely folded back on casing 41, this position being illustrated in FIG. 3. The latching is thus, in principle, irreversible, and opening is prevented unless lever 5 is once again lifted voluntarily by the skier.

Figure 5:
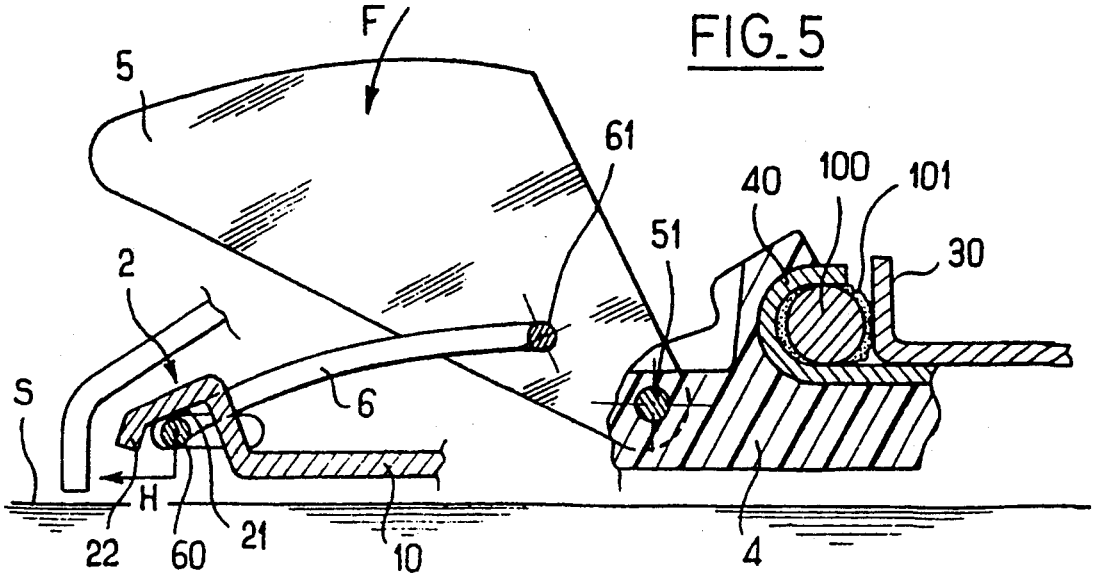
FIG. 5 is a slightly enlarged partial schematic view, similar to FIGS. 2 and 3, illustrating the binding being closed in the presence of a wedge of snow.

In FIG. 5, a situation is illustrated in which a wedge of snow 101 is enclosed, at the same time as axle 100, between jaws 30 and 40. In such a situation, the displacement of slide 4 towards the rear is hindered, and it is not normally possible to sufficiently lower lever 5 along arrow F to cross the over-center line, necessary for latching. However, by virtue of an arrangement of the invention, this becomes possible. Indeed, the force that is generated on the knuckle joint mechanism 5, 6 following the blockage of slide 4 towards the rear is transmitted to the transverse arm 60 of frame 6. This arm is thus displaced towards the front as is shown by arrow H in FIG. 5. This displacement is rendered possible by virtue of the deformable character of the inclined tongue 21, that is lifted by the angling effect. This freedom of controlled displacement of element 6 with the mounting plate 1 towards the front of the support zone enables the overcenter line to be crossed, as soon as the wedge of snow 101 ceases to be excessively thick. It thus becomes possible to close the binding.

Conversely, if wedge 101 is too thick, arm 60 comes in abutment against the tongue portion 22 before crossing the over-center line, and this crossing is not possible.

The device according to the invention thus enables affixing and closing of the binding only with a limited thickness of snow, which is judged to be acceptable.

Figure 3A:
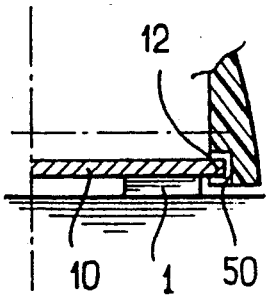
FIG. 3A is a detailed sectional view of the plane A—A in FIG. 3.

As can be seen in FIGS. 2 and 3A, the notches or counter sinks 50 are arranged in the internal surfaces of the lateral cheeks of the lever 5. These notches, in the axial direction, have a size that is slightly bigger than that of the lateral hooks 12, provided on the mounting plate 1. These are normally adapted to be positioned perpendicularly to these hooks when lever 5 is folded back against the ski.

However, if the displacement of slide 4 is inadequate, especially due the presence of a thick wedge of snow, in the direction of latching (return), notches 50 will not position themselves with respect to hooks 12 because lever 5 is affixed to slide 4. This arrangement thus also stops the binding from being closed in case of an excessively thick wedge of snow between jaws 30 and 40.

Conversely, when the binding has been correctly affixed, the cooperation of hooks 12 with notches 50 ensures affixing in the longitudinal direction, of lever 5 with base plate 1, and thus, correlationally, of slide 4 with plate 1. This arrangement thus takes care of any involuntarily release that could result from a displacement of arm 60 towards the front, a displacement that is otherwise permitted due to the elasticity of the connection of this arm in the mounting plate 1.

Figure 7:
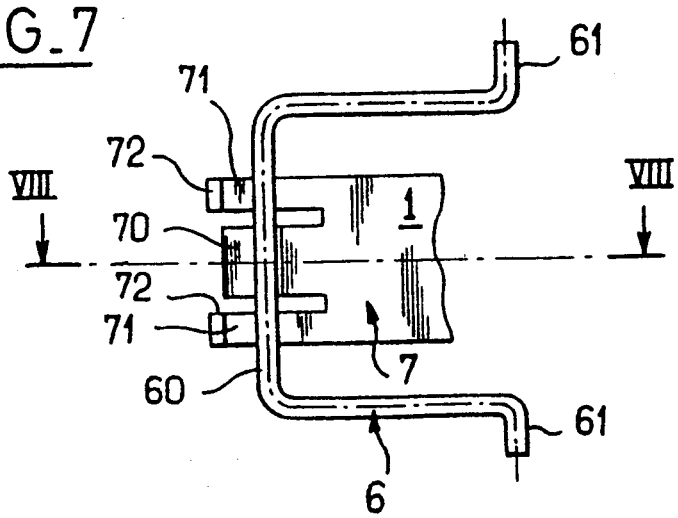
FIG. 7 is a variation of the embodiment of the support according to FIG. 6.

The variation represented in FIG. 7 basically differs from that which has just been described in that the abutments limiting the frontward displacement of arm 60 are formed on tongues other than the tongue that is elastically deformable by the angling effect.

To this end, the front end of the mounting plate 1 has two longitudinal cutouts that demarcate a central tongue 70 and two lateral tongues 71 symmetrically arranged on both sides of the central tongue.

The central tongue 70 is an elastically deformable inclined tongue, as portion 21 of the first embodiment illustrated in FIG. 4; it is this tongue that ensures elastic resistance to the frontward displacement of arm 60.

Figure 8:
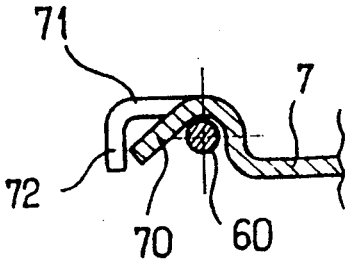
FIGS. 8 and 8A are side views of FIG. 7, sectioned along plane VIII—VIII, respectively before and after displacement of the support zone of the toggle link with respect to the mounting element.
Figure 8A:
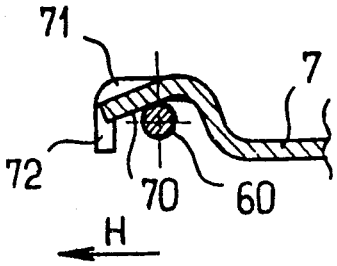

The lateral tongues 71 are arranged horizontally, such that they do not hinder the advance of arm 60; however, their free end is folded back at a right angle towards the base to form an abutment 72; the two abutments 72 thus limit the frontward displacement of arm 60, a displacement illustrated by arrow H in FIG. 8A, a figure that illustrates the deformation of tongue 70 under the effect of frontward displacement of arm 60.

It would naturally be possible to provide a central tongue 70 acting as an abutment and two lateral tongues 71, that are inclined and elastically deformable.

Finally, other means than elastic tongues may be provided to offer resistance to the frontward movement of arm 60, for example, one or several pads made of an elastically deformable synthetic material, and relatively firm at the same time.

Finally, although the invention has been described with reference of particular means, materials and embodiments, it is to be understood that the invention is not limited to the particulars disclosed and extends to all equivalents within the scope of the claims.

What is claimed is:

1. Binding for cross-country skis, said binding being adapted to retain a boot on the ski, said boot having a tip, said tip being provided with a transverse journal axle, said binding comprising a mounting plate fixed on the ski, and a pair of jaws adapted to enclose and retain said axle therebetween, one of said jaws comprising a fixed jaw, being affixed to said mounting plate whereas the other of said jaws comprises a movable jaw, which is axially displaceable on the ski, said binding comprising a knuckle joint latching system that includes a lever journalled around a transverse axis affixed to said movable jaw, and a toggle link journalled on said lever and being supported on said mounting plate, wherein a support zone of the toggle link on said mounting plate is elastically mobile in an axial direction along a limited path, in a direction opposite to a direction of latching of the movable jaw, and wherein the toggle link includes a transverse arm that is supported against an elastically deformable inclined tongue which is provided on said mounting plate.

2. Binding according to claim 1, wherein a free end of the inclined tongue is vertically folded back to constitute an abutment limiting a displacement path of said transverse arm.

3. Binding according to claim 1, wherein the mounting plate is equipped with at least one other tongue arranged beside said inclined tongue, and provided with an end folded back vertically to limit a displacement path of said transverse arm.

4. Binding according to claim 1, wherein said toggle link is elastically deformable.

5. Binding according to claim 1, wherein said toggle link is a wire spring stirrup that, in an elevational view takes the general shape of an "U", wherein the base of the "U" constitutes said transverse arm and wherein a free end, folded back at a right angle, forms bearing necks on said lever.

6. Binding according to claim 1, wherein said movable jaw is carried by a slide guided in translation on the mounting plate.

7. Binding according to claim 1, wherein said and said mounting plate include complementary engagement means, said complementary engagement means being adapted to stop movement of the lever in case of abnormal positioning of the movable jaw with respect to the fixed jaw, when the presence of an excessively thick wedge of snow is between the pair of jaws.

8. Binding for cross-country skis, said binding being adapted to retain a boot on the ski, said boot having a tip, said tip being provided with a transverse journal axle, said binding comprising a mounting plate fixed on the ski, and a pair of jaws adapted to enclose and retain said axle therebetween, one of said jaws comprising a fixed jaw, being affixed to said mounting plate, whereas the other of said jaws comprises a movable jaw, which is axially displaceable on the ski, said binding comprising a knuckle joint latching system that includes a lever journalled around a transverse axis affixed to said movable jaw, and a toggle link journalled on said lever and being supported on said mounting plate, wherein a support zone of the toggle link on said mounting plate is elastically mobile in an axial direction, along a limited path, in a direction opposite to a direction of the latching of the movable jaw, and wherein said lever and said mounting plate include complementary engagement means, said complementary engagement means being adapted to stop movement of the lever in case of abnormal positioning of the movable jaw with respect to the fixed jaw, when the presence of an excessively thick wedge of snow is between the pair of jaws.

9. Binding according to claim 8 wherein the complementary and engagement means includes notches arranged in the lever, and of hooks provided on the mounting plate capable of penetrating into said notches when the lever is brought into an opposed relation with said mounting plate.

* * * * *